US008984912B1

(12) United States Patent
Akin

(10) Patent No.: US 8,984,912 B1
(45) Date of Patent: Mar. 24, 2015

(54) HANDGRIP SLEEVE FOR USE WITH A CROCHET HOOK

(71) Applicant: Jeanie Akin, San Tan Valley, AZ (US)

(72) Inventor: Jeanie Akin, San Tan Valley, AZ (US)

( * ) Notice: Subject to any disclaimer, the term of this patent is extended or adjusted under 35 U.S.C. 154(b) by 0 days.

(21) Appl. No.: 14/069,252

(22) Filed: Oct. 31, 2013

(51) Int. Cl.
*D04B 33/00* (2006.01)
*D04B 3/02* (2006.01)

(52) U.S. Cl.
CPC .. *D04B 33/00* (2013.01); *D04B 3/02* (2013.01)
USPC ..... 66/1 A

(58) Field of Classification Search
CPC ..... D04B 3/00; D04B 3/02; D04B 33/00
USPC ..... 66/118, 117, 1 A
See application file for complete search history.

(56) References Cited

U.S. PATENT DOCUMENTS

| | | | | | |
|---|---|---|---|---|---|
| 39,572 | A | * | 8/1863 | Hoadley | 66/118 |
| 215,979 | A | * | 5/1879 | Ross | 66/118 |
| 1,409,580 | A | * | 3/1922 | Riker | 66/118 |
| 1,415,472 | A | * | 5/1922 | Puc | 66/118 |
| 1,502,584 | A | * | 7/1924 | Perry | 66/118 |
| 1,518,961 | A | | 12/1924 | Burns | |
| 2,246,254 | A | * | 6/1941 | Johnston | 66/118 |
| 2,443,540 | A | * | 6/1948 | Lewis | 66/117 |
| 2,446,622 | A | * | 8/1948 | Turner | 69/21 |
| 2,608,077 | A | * | 8/1952 | Suessman | 66/118 |
| 2,738,662 | A | * | 3/1956 | Carlson | 66/118 |
| 3,019,500 | A | * | 2/1962 | Duffin et al. | 24/561 |
| 3,228,212 | A | * | 1/1966 | Huber | 66/117 |
| 4,601,598 | A | * | 7/1986 | Schwartz et al. | 401/6 |
| 5,016,148 | A | * | 5/1991 | Kohm | 362/102 |
| 5,867,868 | A | * | 2/1999 | Ward | 16/422 |
| D548,953 | S | * | 8/2007 | Pryce | D3/28 |
| 7,621,228 | B2 | * | 11/2009 | Pryce | 112/169 |
| 7,874,181 | B1 | * | 1/2011 | Lindahl | 66/117 |
| 7,874,182 | B1 | * | 1/2011 | Lindahl | 66/118 |
| 2008/0272104 | A1 | | 11/2008 | Farrington | |

* cited by examiner

*Primary Examiner* — Danny Worrell
(74) *Attorney, Agent, or Firm* — RG Patent Consulting, LLC; Rachel Gilboy

(57) ABSTRACT

An apparatus for removably securing resilient cushioning and gripping support to a crochet hook to facilitate its manipulation. Handgrip sleeve for use with a crochet hook is a lightweight, resilient gripping sleeve having an interior cavity for the accommodation of a crochet hook. Complete with gripping members and an elastomeric composition, handgrip sleeve for use with a crochet hook provides increased comfort and decreased fatigue for a user during the completion of a handicraft project.

18 Claims, 5 Drawing Sheets

HANDGRIP SLEEVE FOR USE WITH A CROCHET HOOK

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of handgrips and more specifically relates to removably-secured cushioning handgrip sleeves for crochet hooks.

2. Description of the Related Art

Many individuals in modern society use crochet hooks when completing handicraft projects. As designs and patterns of projects vary, so do the sizes of crochet hooks required to complete these projects. Crochet hooks of every size play vital roles in completing these projects. Easy manipulation of these implements helps to maintain a person's efficiency and good humor when completing a project. As many of these projects take copious amounts of time to complete, the frequent use of crochet hooks may cause individuals to suffer uncomfortable or even painful results: fatigue; hand and finger cramping; and painful blisters and/or calluses. Of specific concern are individuals suffering from debilitating conditions such as arthritis, psoriasis, and the like. Such individuals often struggle to complete crochet and other handicraft projects, as holding and manipulating crochet hooks for even short lengths of time is too painful.

Various attempts have been made to solve the above-mentioned problems such as those found in U.S. Pat. Nos. 2,608,077; 1,518,961; 1,502,584; 7,874,182; 2008/0272104; and U.S. Pat. No. 1,409,580. This prior art is representative of handgrips. None of the above inventions and patents, taken either singly or in combination, is seen to describe the invention as claimed.

Ideally, a removably-secured cushioning handgrip sleeve for crochet hooks should be lightweight, resilient, and user friendly and, yet, would operate reliably and be manufactured at a modest expense. Thus, a need exists for a reliable handgrip system to provide secure resilient cushioning and gripping support for a crochet hook to facilitate its manipulation and to avoid the above-mentioned problems.

BRIEF SUMMARY OF THE INVENTION

In view of the foregoing disadvantages inherent in the known handgrip art, the present invention provides a novel handgrip sleeve for use with a crochet hook system. The general purpose of the present invention, which will be described subsequently in greater detail, is to provide secure resilient cushioning and gripping support for a crochet hook to facilitate its manipulation.

A handgrip sleeve for use with a crochet hook system is disclosed herein preferably comprising: a handgrip body having a first end, a second end, an outer surface, an inner surface, and an inner cavity. In preferred embodiments, the handgrip body comprises a prismatic configuration with a circular cross-section. This essentially cylindrical handgrip body comprises an inner cavity that extends lengthwise through the handgrip body. The inner cavity of the handgrip body acts as a void, this void being defined by the inner surface of the handgrip body. In preferred embodiments, a crochet hook is friction-fit within the inner cavity of the handgrip body allowing a user to more securely and comfortably manipulate the crochet hook over a duration of use.

Ideally, the inner cavity of the handgrip body extends throughout essentially the center of the handgrip body from the first end to the second end. The inner cavity thereby creates an entrance orifice in the first end and an exit aperture at the second end of the handgrip body that preferably engage a crochet hook so as to allow the functional end of the crochet hook to protrude from the handgrip body at a sufficient distance to allow the functional use thereof. Additionally, the handgrip body may comprise a slit extending lengthwise along the entire handgrip body, penetrating the handgrip body laterally from the outer surface to the inner surface, thereby effectively creating a channel capable of acting as both an access point and an enclosure for the crochet hook within the handgrip body. The handgrip body may additionally comprise an end cap that covers the second end of the handgrip body. Such an end cap acts as a barrier to prevent the protrusion of the crochet hook from the exit aperture, effectively retaining the shank of the crochet hook within the confines of the inner cavity.

For cushioning and gripping purposes, the handgrip body preferably comprises an elastomer such as a shape-memory polymer or the like. The shape-memory polymer is capable of being deformed according to a user's hand by the pressure exerted by a user, and therefore effectively produces a perfectly shaped handgrip body to most comfortably and securely fit a user. In preferred embodiments, the handgrip body may be sufficiently deformable to accommodate crochet hooks of various sizes within one handgrip body, making the handgrip body a versatile gripping apparatus.

Additionally, the handgrip body may comprise pre-formed finger grips in which the outer surface of the handgrip body comprises concave finger indentations separated one from another by a convex spacer mound. In preferred embodiments, the outer surface of the handgrip body comprises a non-slip coating and one or more protrusions that act as additional gripping members. As each user necessitates varying comfort and support arrangements, a plurality of handgrip bodies may be arranged in series on one crochet hook, thereby altering the overall shape and performance of the handgrip sleeve for use with a crochet hook system.

A method of using a handgrip sleeve for use with a crochet hook system is also described herein preferably comprising the steps of: inserting a crochet hook into an entrance orifice of a handgrip body; pushing the crochet hook through the handgrip body, causing it to protrude from an exit aperture; and gripping the handgrip body, and thereby manipulating the crochet hook during the performance of at least one project. The method preferably further comprises the step of adding additional handgrip bodies as desired to create a personalized handgrip sleeve for use with a crochet hook.

The present invention holds significant improvements and serves as a handgrip system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, Handgrip Sleeve for Use with a Crochet Hook, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a handgrip device and more particularly to a handgrip sleeve for use with a crochet hook as used to improve the secure cushioning and gripping support for a crochet hook to facilitate its manipulation.

Figure 1:
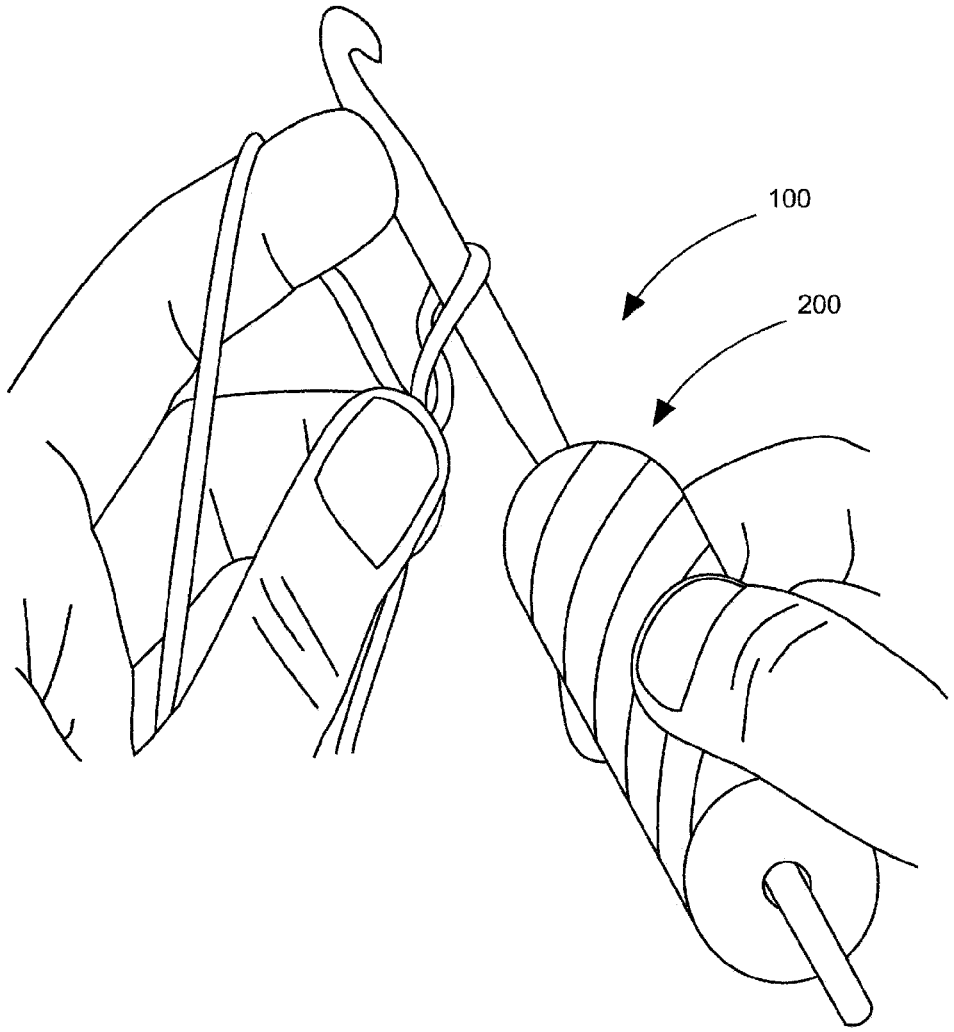
FIG. 1 shows a perspective view illustrating a handgrip sleeve for use with a crochet hook according to an embodiment of the present invention.

Referring now to the drawings by numerals of reference there is shown in FIG. 1, a perspective view illustrating a handgrip sleeve for use with a crochet hook 100 according to an embodiment of the present invention.

Handgrip sleeve for use with a crochet hook 100 preferably comprises: handgrip body 200 preferably having first end 215; second end 220; outer surface 205; inner surface 210; and at least one inner cavity 225. Ideally, handgrip sleeve for use with a crochet hook 100 may be modifiable in size and shape in order to meet the needs and/or preferences of a user. Length and/or thickness of each handgrip body 200 may be variable within the present embodiment, yet alternate embodiments may consist of handgrip bod(ies) 200 of standard lengths and/or thicknesses.

Figure 4A:
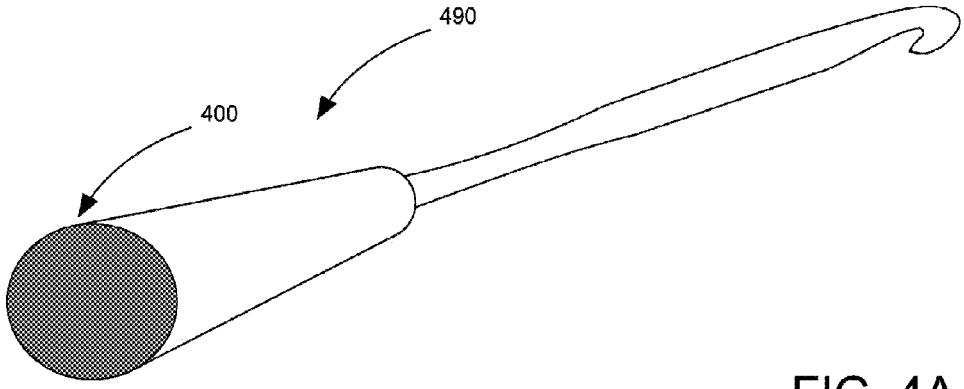
FIGS. 4A-4C are perspective views illustrating the handgrip sleeve for use with a crochet hook according to an embodiment of the present invention of FIGS. 1-3C.
Figure 4B:
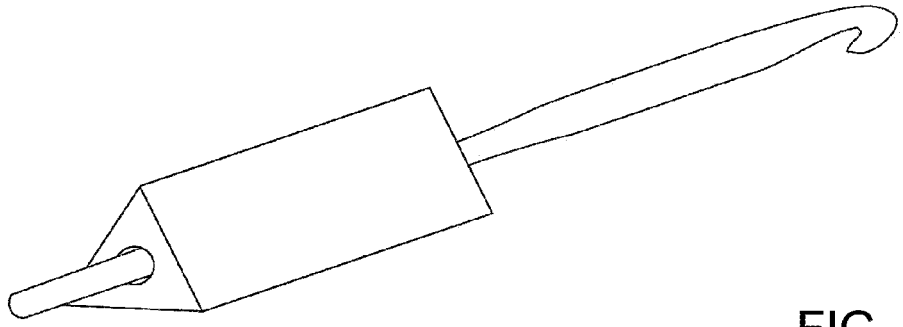

Within this particular embodiment, handgrip body 200 may comprise a prismatic configuration, thereby effectively maintaining a constant overall thickness throughout the length of handgrip body 200. Alternatively, handgrip body 200 may be tapered, as shown in FIG. 4A, thereby effectively creating a non-prismatic configuration. Additionally, in this particular embodiment, handgrip body 200 may comprise a circular cross-section. Alternatively, handgrip body 200 may comprise a non-circular configuration such as triangular, rectangular, octagonal, or the like, as shown in FIG. 4B. Regardless of overall size and shape of handgrip body 200, handgrip body 200 may preferably be adapted to hold a shank of a crochet hook within inner cavity 225 such that crochet hook may be removably secured and comfortably gripped and manipulated by a user during at least one duration of use.

Figure 2A:
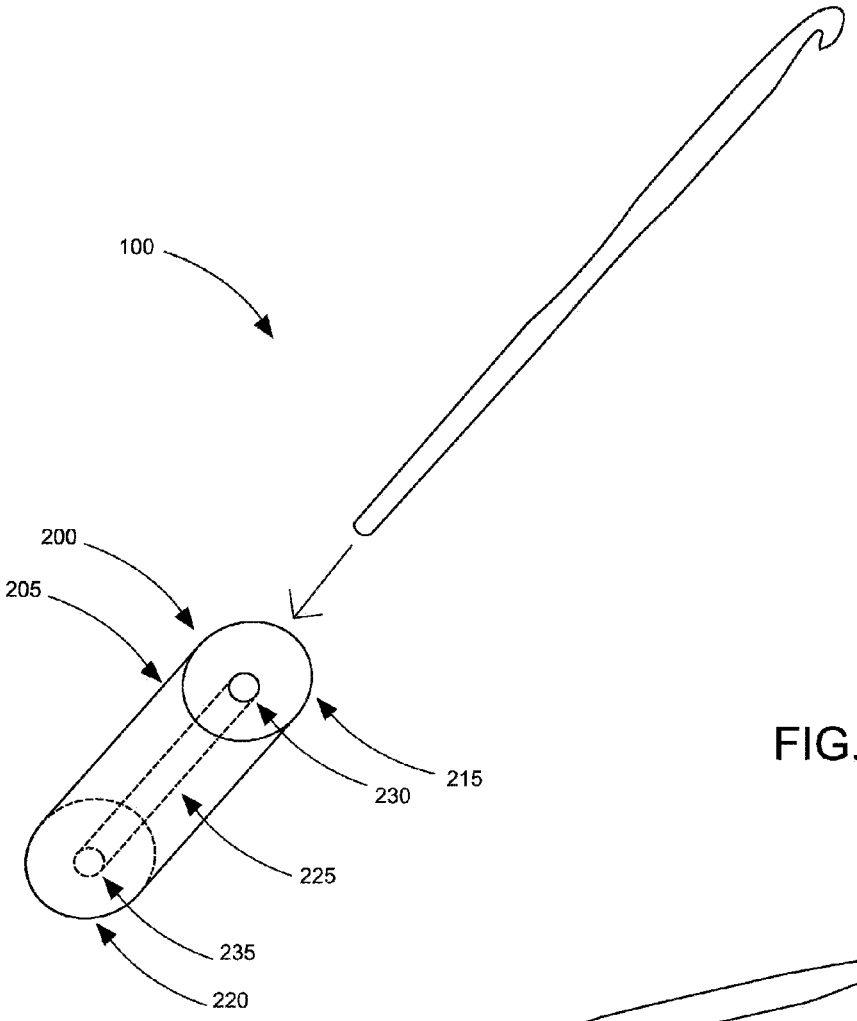
FIGS. 2A-2B are perspective views illustrating the handgrip sleeve for use with a crochet hook with an inner cavity and a slit according to an embodiment of the present invention of FIG. 1.
Figure 2B:
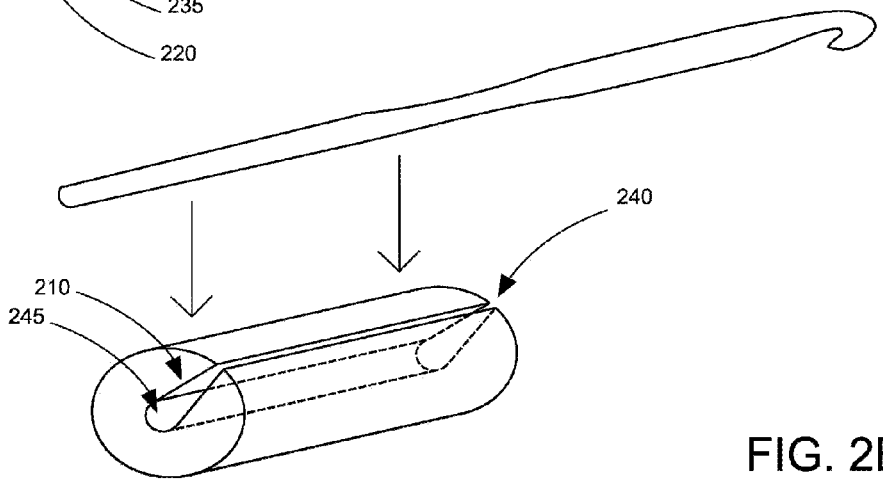

FIGS. 2A-2B are perspective views illustrating handgrip sleeve for use with a crochet hook 100 with inner cavity 225 and slit 240 according to an embodiment of the present invention of FIG. 1.

Inner surface 210 preferably defines inner cavity 225 which may act in a capacity of a void. Ideally, inner cavity 225 extends lengthwise within handgrip body 200 from first end 215 to second end 220. In other embodiments, inner cavity 225 may extend only partially throughout the length of handgrip body 200, extending only from either first end 215 or second end 220 but not simultaneously intersecting both first end 215 and second end 220. Any intersection of inner cavity 225 with first end 215 effectively creates entrance orifice 230.

Alternately, any intersection of inner cavity 225 with second end 220 effectively creates exit aperture 235. Entrance orifice 230 and exit aperture 235 essentially act in the capacity of entrance and exit points, respectively, for a crochet needle engaging handgrip body 200. A crochet hook may preferably be friction-fit within the confines of inner cavity 225, abutting inner surface 210 of handgrip body 200, such that the crochet hook may be inserted into entrance orifice 230; driven through inner cavity 225; and expelled from exit aperture 235 of handgrip body 200 for use. While handgrip body 200 of the present embodiment comprises one inner cavity 225, handgrip body 200 of alternate embodiments may comprise a plurality of inner cavit(ies) 225.

In the present embodiment, handgrip body 200 may preferably comprise slit 240. Slit 240 may preferably extend: longitudinally along handgrip body 200 from first end 215 to second end 220; and laterally through handgrip body 200 from outer surface 205 to inner cavity 225. Any intersection of slit 240 and inner cavity 225 may preferably define channel 245, which ideally acts in a capacity of both an access point and an enclosure for a crochet hook engaging handgrip body 200. In alternate embodiments, slit 240 may extend only partially along handgrip body 200—extending laterally either from first end 215 or from second end 220 but not simultaneously intersecting both first end 215 and second end 220.

Within the present embodiment, slit 240 is preferably narrower than a diameter of a crochet hook, thereby essentially preventing a crochet hook from being unintentionally removed from handgrip body 200. Upon reading this specification, it should be appreciated that, under appropriate circumstances, considering such issues as user preferences, design preference, structural requirements, marketing preferences, cost, available materials, technological advances, etc., other securing and fastening arrangements such as, for example, adhesive, cords, zippers, hook-and-loop fasteners, etc., may be sufficient. Those with ordinary skill in the art will now appreciate that upon reading this specification and by their understanding the art of securing and/or sealing crevices as described herein, methods of securing and/or sealing crevices will be understood by those knowledgeable in such art.

Figure 3A:
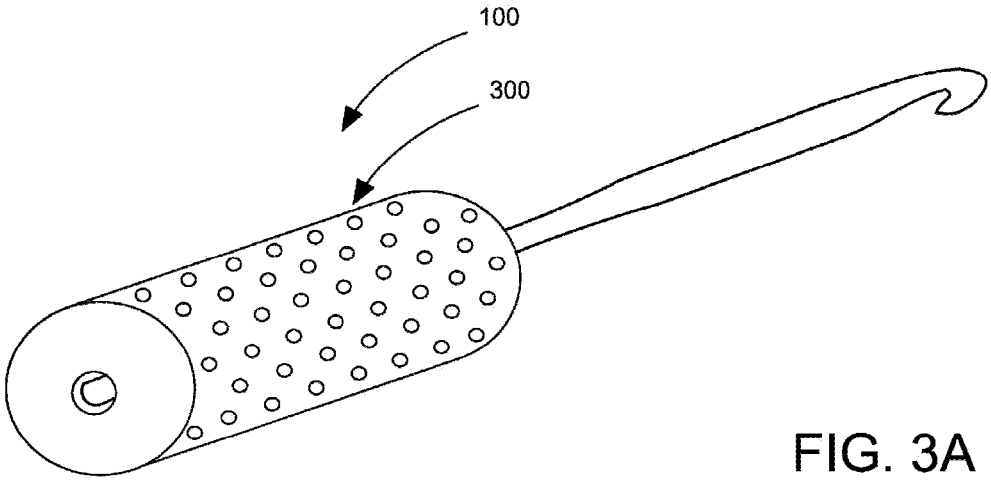
FIGS. 3A-3C are perspective views illustrating the handgrip sleeve for use with a crochet hook with protrusions according to an embodiment of the present invention of FIGS. 1-2B.
Figure 3B:
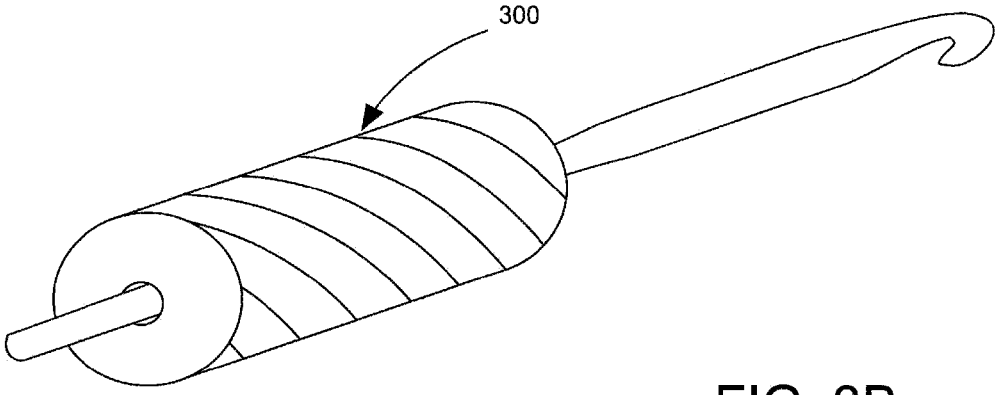
Figure 3C:
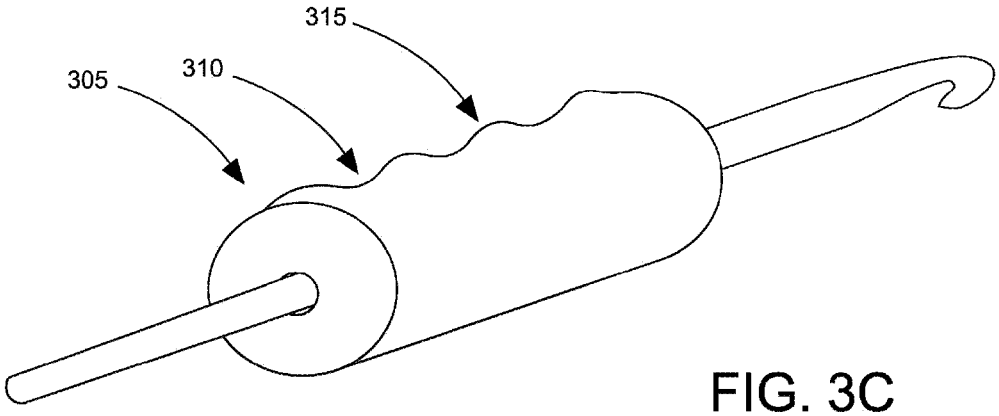

FIGS. 3A-3C are perspective views illustrating handgrip sleeve for use with a crochet hook 100 with protrusion(s) 300 according to an embodiment of the present invention of FIGS. 1-2B.

Ideally, an interior of handgrip body 200 may preferably be sufficiently deformable to accommodate a plurality of sizes of crochet hooks. Within the present embodiment, handgrip body 200 may accommodate a single crochet hook; however, in alternate embodiments, handgrip body 200 may accommodate multiple crochet hooks to accommodate the needs and/or preferences of a user. Handgrip body 200 may comprise a resilient foam; a soft resin; and, alternately, an elastomer such as silicone rubber utilizing injection molding to create a desired shape and size. Handgrip body 200 may comprise a shape-memory polymer capable of being deformed according to the shape of a user's hands and the pressure exerted thereby upon handgrip body 200. Upon reading this specification, it should be appreciated that, under appropriate circumstances, considering such issues as user preferences, design preference, structural requirements, marketing preferences, cost, available materials, technological advances, etc., other deformable material arrangements such as, for example, rubber, polystyrene beads, etc., may be sufficient. Those with ordinary skill in the art will now appreciate that upon reading this specification and by their understanding the art of molding and/or casting as described herein, methods of molding and/or casting handgrips will be understood by those knowledgeable in such art.

Handgrip body 200 may comprise pre-formed finger grip(s) 305 along outer surface 205. Planar outer surface 205 may preferably be interrupted by at least one concave finger indentation 310 which may be separated from any additional finger indentation(s) 310 by at least one convex spacer mound 315. Handgrip body 200 of the present embodiment preferably comprises a plurality of finger indentation(s) 310 and spacer mound(s) 315 in a series relationship, preferably occurring in an alternating pattern. Alternately, (and in some embodiments, additionally) handgrip body 200 may comprise at least one protrusion 300 along outer surface 205. Protrusion 300 preferably acts in a capacity of a gripping member. Handgrip body 200 of preferred embodiments comprise a plurality of protrusion(s) 300 to increase the security of a user's grasp of handgrip sleeve for use with a crochet hook 100 and his or her manipulation thereof. Protrusion(s) 300 may take the form of ridges, raised bumps, and the like. Those with ordinary skill in the art will now appreciate that upon reading this specification and by their understanding the art of gripping member construction as described herein, methods of constructing gripping members will be understood by those knowledgeable in such art.

Figure 4C:
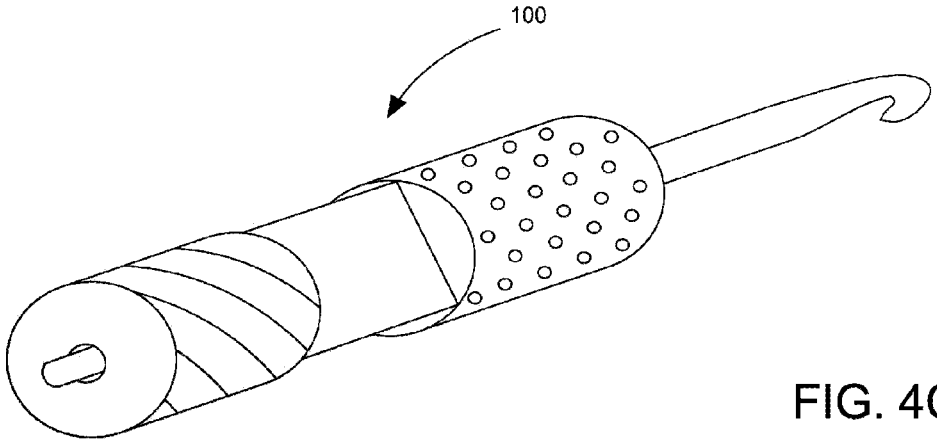

FIGS. 4A-4C are perspective views illustrating handgrip sleeve for use with a crochet hook 100 according to an embodiment of the present invention of FIGS. 1-3C.

In order to retain a crochet hook within handgrip body 200, handgrip body 200 may comprise end cap 400, as shown in FIG. 4A. End cap 400 may be releasably secured to first end 215 or second end 220 of handgrip body 200 and act in a capacity of a barrier to prevent a crochet hook from protruding from entrance orifice 230 or exit aperture 235, respectively. While end cap 400 of the present embodiment may be releasably connected to handgrip body 200, handgrip body 200 of alternate embodiments may comprise an integral end cap 400 created by the partial extension of inner cavity 225 (as opposed to its full extension) throughout handgrip body 200. Those with ordinary skill in the art will now appreciate that upon reading this specification and by their understanding the art of securing and fastening as described herein, methods of releasably securing structural elements one to another will be understood by those knowledgeable in such art.

Both outer surface 205 and inner surface 210 may comprise a non-slip coating. A non-slip coating along inner surface 210 may act as an additional securing means for a crochet hook within handgrip body 200, which may essentially prevent: undesired rotation of a crochet hook within inner cavity 225; and undesired removal of a crochet hook from within inner cavity 225. A non-slip coating along outer surface 205 may act as an additional steadying and securing means for a crochet hook within a user's hand during use. Upon reading this specification, it should be appreciated that, under appropriate circumstances, considering such issues as user preferences, design preference, structural requirements, marketing preferences, cost, available materials, technological advances, etc., other gripping material arrangements such as, for example, surface projections, magnets, fasteners, etc., may be sufficient. Those with ordinary skill in the art will now appreciate that upon reading this specification and by their understanding the art of surface coating and/or texturing as described herein, methods of coating and/or texturing surfaces will be understood by those knowledgeable in such art.

As is shown in FIG. 4C, a plurality of handgrip bod(ies) 200 may preferably be arranged in series on one crochet hook. Each configuration and placement of individual handgrip bod (ies) 200 may alter an overall shape and performance of handgrip sleeve for use with crochet hook 100. In this way, a user may manipulate the number and placement of handgrip bod(ies) 200 on a crochet hook in order to reach a desired configuration to effectively ensure optimal security and comfort when grasping and manipulating the crochet hook during use.

Handgrip sleeve for use with a crochet hook system 100 may be sold as kit 490 comprising the following parts: at least one handgrip body 200; at least one end cap 400; and at least one set of user instructions. Handgrip sleeve for use with a crochet hook 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
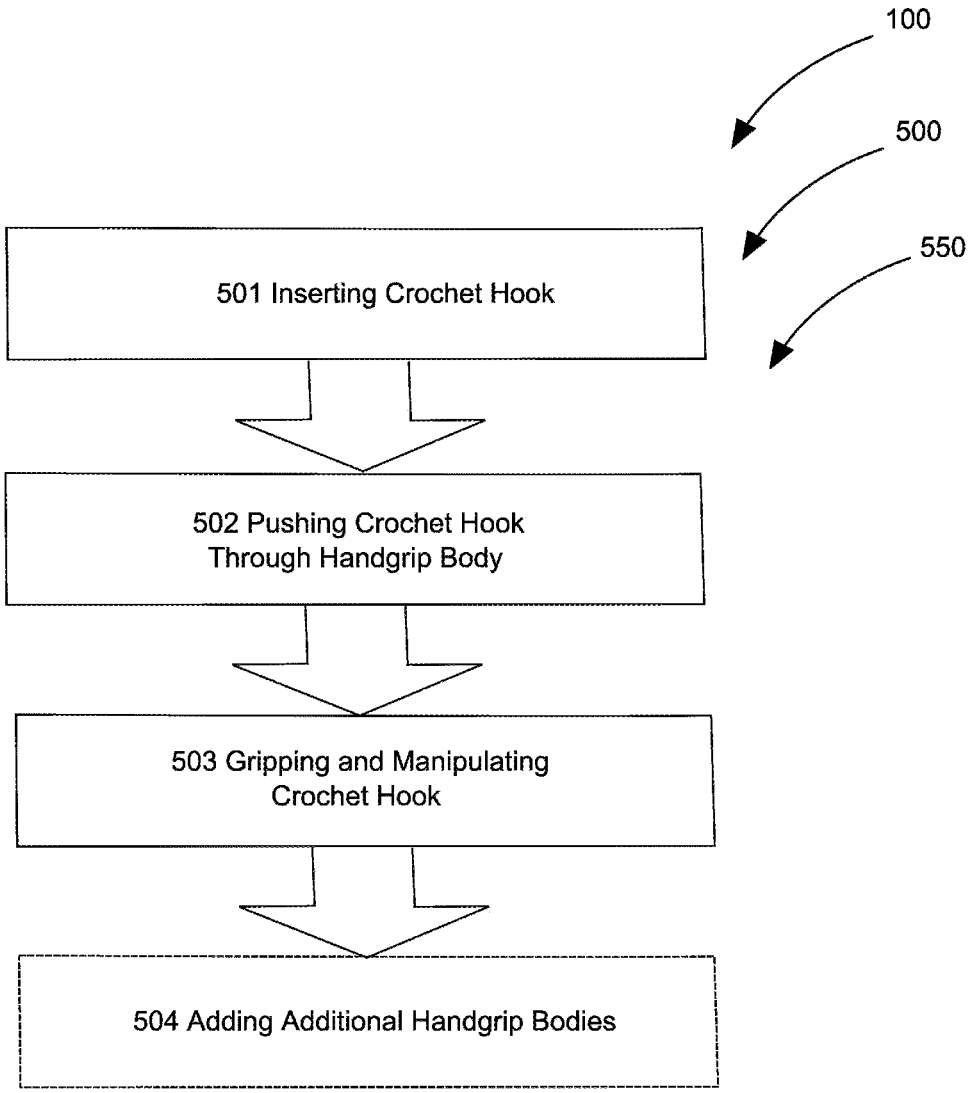
FIG. 5 is a flowchart illustrating the handgrip sleeve for use with a crochet hook according to an embodiment of the present invention of FIGS. 1-4C.

FIG. 5 is flowchart 550 illustrating handgrip sleeve for use with a crochet hook 100 according to an embodiment of the present invention of FIGS. 1-4C.

A method of using (at least hereby enabling method of use 500) a handgrip sleeve for use with a crochet hook 100 preferably comprising the steps of: step one 501 inserting a crochet hook into entrance orifice 230 of handgrip body 200; step two 502 pushing the crochet hook through handgrip body 200 to protrude from exit aperture 235; and step three 503 gripping handgrip body 200 and thereby manipulating the crochet hook during a performance of at least one project. The method of use 500 preferably further comprises the step of: step four 504 adding additional handgrip bod(ies) 200 as desired to create a personalized handgrip sleeve for use with a crochet hook 100.

It should be noted that step four 504 is an optional step and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A handgrip sleeve for use with a crochet hook system comprising:

a) a handgrip body having;
   i) a first end;
   ii) a second end;
   iii) an outer surface;
   iv) an inner surface; and
   v) an inner cavity; and b) a crochet hook;

c) wherein said inner cavity structured and arranged as a void, said void being defined by said inner surface of said handgrip body and extending to said first end and said second end;

d) wherein said inner cavity extends longitudinally throughout said handgrip body, thereby creating both an entrance orifice in said first end of said handgrip body and an exit aperture at said second end of said handgrip body; and e) wherein said handgrip body is adapted to hold a shank of said crochet hook within said inner cavity such that said crochet hook may be removably secured and comfortably gripped and manipulated by a user during at least one duration of use;

f) wherein an interior of said handgrip body is sufficiently deformable to accommodate said shanks of said crochet hooks of various sizes within one said handgrip body for use with said crochet hook;

g) wherein said handgrip body comprises an elastomer, resilient foam, gel, or shape-memory polymer;

h) wherein said shape-memory polymer of said handgrip body is structured and arranged to deform according a shape of a user's hands and pressure exerted thereby upon said handgrip body;

i) wherein said outer surface and said inner surface of said handgrip body comprise a non-slip coating.

2. The handgrip sleeve for use with a crochet hook system of claim 1 wherein said handgrip body comprises a prismatic configuration.

3. The handgrip sleeve for use with a crochet hook system of claim 1 wherein said handgrip body is tapered, thereby creating a non-prismatic configuration.

4. The handgrip sleeve for use with a crochet hook system of claim 1 wherein said handgrip body comprises a circular cross-section.

5. The handgrip sleeve for use with a crochet hook system of claim 1 wherein said handgrip body comprises a non-circular cross-section.

6. The handgrip sleeve for use with a crochet hook system of claim 1 wherein said crochet hook is friction-fit within confines of said inner cavity abutting said inner surface of said handgrip body, being inserted into said entrance orifice and protruding from said exit aperture of said handgrip body for use.

7. The handgrip sleeve for use with a crochet hook system of claim 1 wherein said handgrip body comprises a slit, said slit extending longitudinally along said handgrip body from said first end to said second end and extending laterally from said outer surface to said inner cavity, width of said slit further structured and arranged narrower than narrowest diameter of said crochet hook, an intersection of said slit and said inner cavity defining a channel, said channel structured and arranged as both an access point and an enclosure for said crochet hook.

8. The handgrip sleeve for use with a crochet hook system of claim 1 wherein said handgrip body comprises only said elastomer.

9. The handgrip sleeve for use with a crochet hook system of claim 1 wherein said handgrip body comprises only said resilient foam.

10. The handgrip sleeve for use with a crochet hook system of claim 1 wherein said handgrip body comprises only said gel.

11. The handgrip sleeve for use with a crochet hook system of claim 1 wherein said handgrip body comprises only said shape-memory polymer.

12. The handgrip sleeve for use with a crochet hook system of claim 1 wherein said handgrip body comprises pre-formed finger grips, wherein planar said outer surface is interrupted by at least one concave finger indentation separated from any additional said finger indentations by at least one convex spacer mound.

13. The handgrip sleeve for use with a crochet hook system of claim 1 wherein said outer surface of said handgrip body comprises at least one protrusion, wherein said protrusion structured and arranged as a gripping member.

14. The handgrip sleeve for use with a crochet hook system of claim 1 wherein said handgrip body comprises an end cap, said end cap structured and arranged as a barrier to prevent said crochet hook from protruding from said exit aperture of said handgrip body.

15. The handgrip sleeve for use with a crochet hook system of claim 1 wherein a plurality of said handgrip bodies may be arranged in series on one said crochet hook, a configuration and placement of each said handgrip body thereby altering an overall shape and performance of said handgrip sleeve for use with said crochet hook system.

16. A handgrip sleeve for use with a crochet hook system comprising:

a) a handgrip body having a first end; a second end; an outer surface; an inner surface; and an inner cavity;

b) wherein said handgrip body comprises a prismatic configuration and alternately comprises a non-prismatic configuration;

c) wherein said handgrip body comprises a circular cross-section;

d) wherein said inner cavity structured and arranged as a void, said void being defined by said inner surface of said handgrip body;

e) wherein said inner cavity extends longitudinally throughout said handgrip body, thereby creating both an entrance orifice in said first end of said handgrip body and an exit aperture at said second end of said handgrip body;

f) wherein a crochet hook is friction-fit within confines of said inner cavity abutting said inner surface of said handgrip body, inserted into said entrance orifice and protruding from said exit aperture of said handgrip body;

g) wherein said handgrip body comprises a slit, said slit extending longitudinally along said handgrip body from said first end to said second end and extending laterally from said outer surface to said inner cavity, an intersection of said slit and said inner cavity defining a channel, said channel structured and arranged as both an access point and an enclosure for said crochet hook;

h) wherein said handgrip body comprises an elastomer;

i) wherein said handgrip body comprises a shape-memory polymer, said shape-memory polymer deformed according to a shape of a hand of a user and a pressure exerted thereby upon said handgrip body;

j) wherein said handgrip body comprises pre-formed finger grips, wherein planar said outer surface is interrupted by at least one concave finger indentation separated from any additional said finger indentations by at least one convex spacer mound;

k) wherein the interior of said handgrip body is sufficiently deformable to accommodate crochet hooks of various sizes within one handgrip body for use with said crochet hook;

l) wherein said outer surface of said handgrip body comprises a non-slip coating and at least one protrusion, wherein said protrusion structured and arranged as a gripping member;

m) wherein said handgrip body comprises an end cap, said end cap acts as a barrier structured and arranged to prevent said crochet hook from protruding from said exit aperture of said handgrip body;

n) wherein a plurality of said handgrip bodies arranged in a series relationship on one said crochet hook, a configuration and placement of each said handgrip body thereby altering an overall shape and performance of said handgrip sleeve for use with said crochet hook system; and o) wherein said handgrip body is adapted to hold a shank of said crochet hook within said inner cavity and further structured and arranged such that said crochet hook is removably secured and comfortably gripped and manipulated by said user during at least one duration of use.

17. A method of using the handgrip sleeve for use with a crochet hook of claim 16 comprising the steps of:

a) inserting a crochet hook into an entrance orifice of a handgrip body;

b) pushing said crochet hook through said handgrip body to protrude from an exit aperture; and c) gripping said handgrip body and thereby manipulating said crochet hook during a performance of at least one project.

18. The method of claim 17 further comprising the step of adding additional said handgrip bodies as desired to create a personalized handgrip sleeve for use with a crochet hook.

* * * * *